United States Patent [19]

Sheu

[11] Patent Number: 4,974,267

[45] Date of Patent: Dec. 4, 1990

[54] STRUCTURE OF BABY BATHTUB

[76] Inventor: Miin-Shiou Sheu, No 156, Cheng Kung Road, Changhua, Taiwan

[21] Appl. No.: 467,176

[22] Filed: Jan. 19, 1990

[51] Int. Cl.[5] ..... A47K 3/024

[52] U.S. Cl. ..... 4/572; 4/586; 4/587; 4/659; 4/564

[58] Field of Search ..... 4/559, 553, 572–573, 4/575, 564, 578–579, 546, 586, 589, 661, 659, 538, 605, 539, 519; 128/365, 371

[56] References Cited

U.S. PATENT DOCUMENTS

| | | | |
|---|---|---|---|
| 1,512,068 | 10/1924 | Thornburg | 4/589 X |
| 2,203,223 | 6/1940 | Kennedy | 4/538 X |
| 2,760,208 | 8/1956 | Mussells | 4/572 |
| 2,828,489 | 4/1958 | Baker | 4/589 |
| 3,799,228 | 3/1974 | Crawford | 4/538 X |
| 3,965,496 | 6/1976 | Grelle | 4/572 X |
| 4,216,552 | 8/1980 | Gurolnick | 4/572 X |
| 4,266,306 | 5/1981 | Lee | 4/572 |
| 4,881,281 | 11/1989 | Lavoine et al. | 4/572 |

FOREIGN PATENT DOCUMENTS

| | | | |
|---|---|---|---|
| 2193887 | 8/1986 | United Kingdom | 4/572 |

*Primary Examiner*—Henry K. Artis

*Attorney, Agent, or Firm*—Bacon & Thomas

[57] ABSTRACT

A baby bathtub is provided with a housing having therein a supporting frame assembly controlled by a control rod assembly through an extension handle to move upward or downward along four dovetail-like vertical projections on the inner wall thereof so as to adjust the level position of a mattress which is mounted on the supporting frame assembly for the lying thereon of a baby. Drain pipe is attached to the housing and controlled by a drain control device.

2 Claims, 3 Drawing Sheets

STRUCTURE OF BABY BATHTUB

BACKGROUND OF THE INVENTION

1. Field of Invention

The present invention relates to baby bathtubs and more particularly to a baby bathtub which comprises a liftable supporting frame assembly received in the housing thereof to support a mattress comfortably for the lying thereon of a baby.

2. Description of the Prior Art

Conventional baby bathtubs may vary in shape or design, they commonly comprise a housing for containing water. When a baby is put in a bathtub to take a bath, one must have one's one hand supporting the body of a baby and use one's other hand washing the body of such a baby. It is not stable to support a baby with one hand and difficult to wash a baby with the other hand. Any carelessness may cause accident or injury to a baby during washing in a conventional bathtub. Further, conventional baby bathtubs do not have any drain pipe or drain valve for drainage of water. It is bothersome to pour the water out of a conventional baby bathtub.

SUMMARY OF THE INVENTION

An object of the present invention is to provide a baby bathtub which can efficiently eliminate the foregoing problems.

Another object of the present invention is to provide a baby bathtub which comprises supporting frame assembly controlled by a control rod assembly to lift along four dovetail-like projections on the inner wall of its housing so that the level position of the mattress which is mounted on the supporting frame assembly for the lying thereon of a baby can be properly adjusted.

Still another object of the present invention is to provide a baby bathtub which comprises a liftable mattress having an orthopedically engineered upper surface comprised of a raised sloping surface portion at its upper end, a ridge portion in the middle, and a scoop-like surface portion at its lower end such that a bay can comfortably lie thereon with baby's head lying upward to prevent from permeation of water into baby's ears during bathing.

Still another object of the present invention is to provide a baby bathtub which comprises a retainer member on the housing thereof, having a plurality of hook portions thereon for the positioning of the extension handle of a control rod assembly so that the level position of a mattress therein can be alternatively adjusted.

Still another object of the present invention is to provide a baby bathtub which comprises unitary dovetail-like vertical projections on the inner wall of the housing thereof to stabilize the lifting of a supporting frame assembly in the housing thereof.

Still another object of the present invention is to provide a baby bathtub which comprises a control rod assembly for controlling the level position of a mattress, which control rod is controlled by means of an extension handle which is easy to operate.

A yet further object of the present invention is to provide a baby bathtub which comprises a drain pipe extending from the lowest point of a sloping recess in the housing thereof and controlled by a drain control device to open its passage for the draining of water out of the housing or to block up its passage for the filling of water in the housing.

BRIEF DESCRIPTION OF THE DRAWINGS

The foregoing and other objects, features and advantages of the present invention will be best understood from the following description, the appended claims and the accompanying drawings in which:

DETAILED DESCRIPTION OF THE PREFERRED EMBODIMENTS

Figure 1:
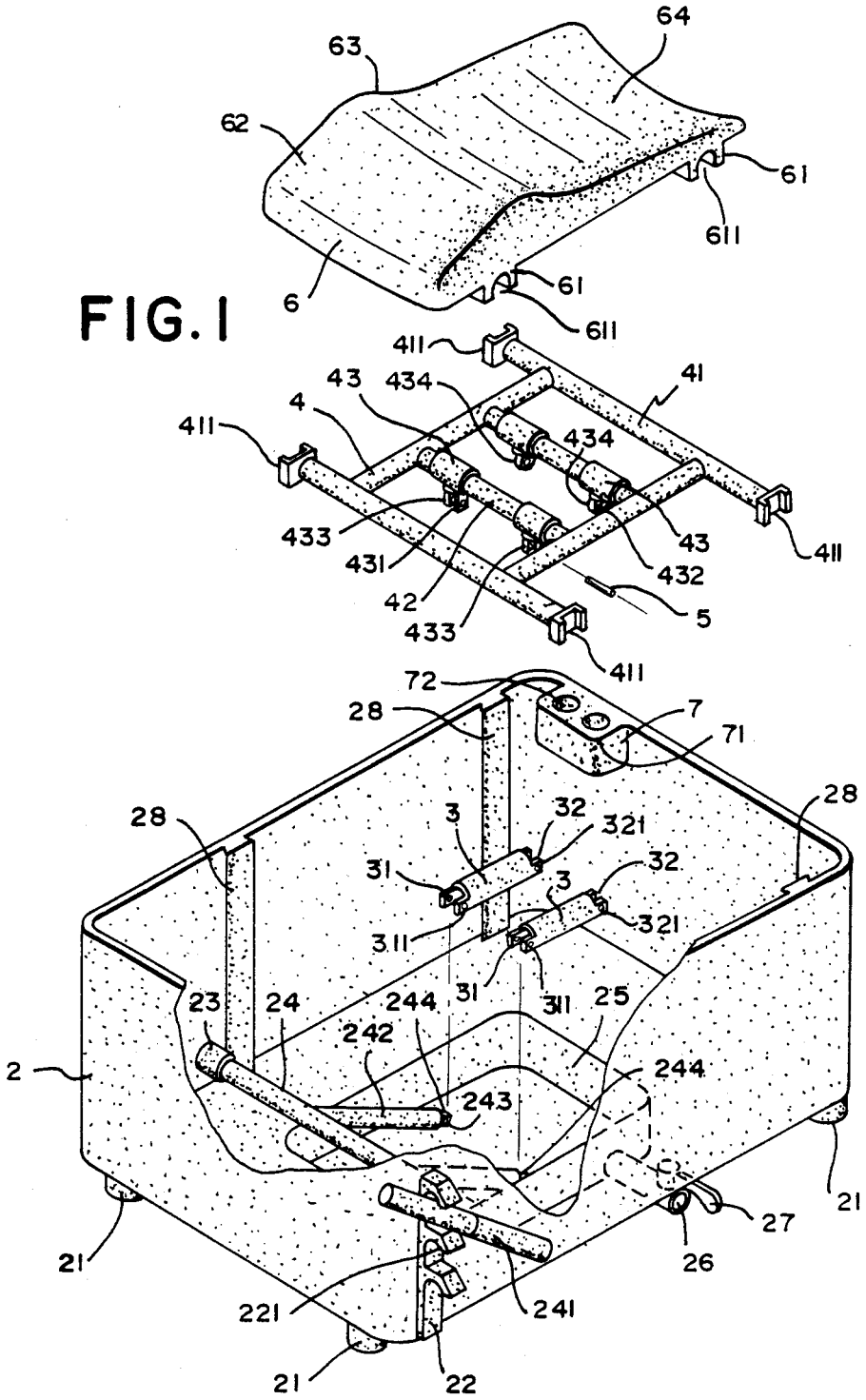
FIG. 1 is a fragmentary perspective view of a baby bathtub embodying the present invention.
Figure 2:
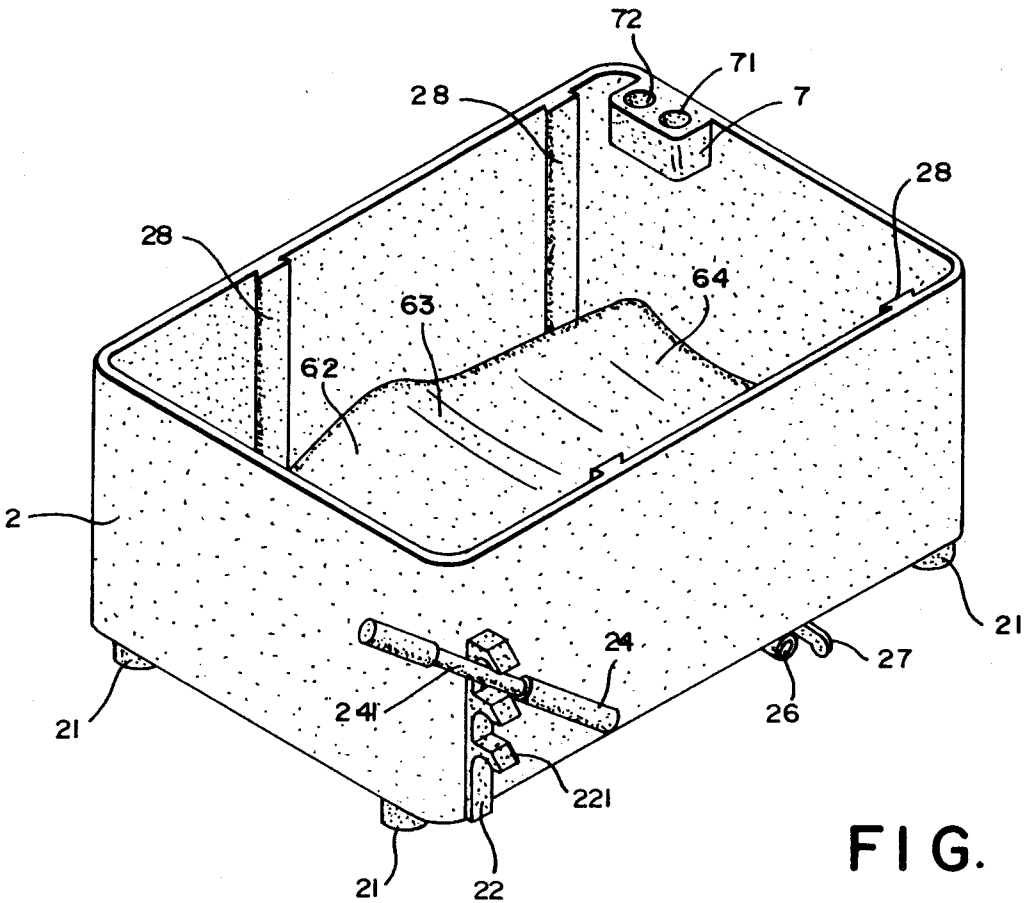
FIG. 2 is a perspective assembly view of the baby bathtub of FIG. 1.

Turning now to the annexed drawings in greater detail and referring first to FIGS. 1 and 2, therein illustrated is a baby bathtub embodying the present invention and generally comprised of a rectangular housing 2, two toggle members 3, a supporting frame assembly 4, four lock pins 5, and a mattress 6.

As illustrated, the rectangular housing 2 comprises four legs 21 extending downward from its bottom at its four corners. A retainer member 22 which comprises three hook portions 221 is vertically made on the outer wall of the housing 2 at its one corner. A unitary sleeve 23 projecting from the inner wall of the housing 2 opposite to the retainer member 22 for the insertion therein of a control rod assembly 24. The control rod assembly 24 comprises an extension handle 241 which is exposed outside the housing 2 and retained by the retainer member 22, two link rods 242 are vertically extending therefrom in parallel relationship to each other and comprise each a connecting end 244 having a round hole 243 thereon. A sloping recess 25 is made on the inner bottom of the housing 2. A drain pipe 26 extends from the sloping recess 25 for drainage of water from the housing 2, which is controlled by a drain control device 27. Four unitary dovetail-like projections 28 are respectively made on the inner wall surface of the housing 2 with two on one side and the other two on the opposite side.

The two toggle members 3, each comprises two notch potions 31 and 32 at both ends and having respectively, a through-hole 311 or 321 penetrating therethrough.

The supporting frame assembly 4 comprises a ladder-like frame 42 having two side rods 41 secured thereto in parallel at both ends. The ladder-like rod frame 42 of the supporting frame assembly 4 has four sleeve-like fastening members 43 movably mounted thereon, wherein the two rear fastening members 43 comprise each, a male fastening end 434 having a round hole 432 penetrating therethrough, and the other two front fastening members 43 comprise each, a female fastening end 433 having a round hole 431 penetrating therethrough. The two side rods 41 comprise each, two dovetail-like retaining plates 411 at both ends.

The mattress 6 comprises two bottom rail portions 61 on its bottom surface, each defining therein a channel 611. The upper surface of the mattress 6 is comprised of a raised sloping surface portion 62 at its upper end, a ridge portion 63 in the middle, and a scoop-like surface portion 64 at its lower end.

During assembly, the supporting frame assembly 4 is positioned in the housing 2 permitting the dovetail-like retaining plates 411 of the two side rods 41 to respectively engage with the four dovetail-like projections 28. The connecting ends 244 of the two link rods 242 of the control rod assembly 24 are respectively set in the front notch portions 31 of the two toggle members 3 and concomitantly set in the female fastening ends 433 of the two sleeve-like front fastening members 43 and pivotably secured thereto by means of two lock pins 5. The male fastening ends 434 of the two sleeve-like rear fastening members 43 are respectively set in the two rear notch portions 32 of the two toggle members 3 and pivotably secured thereto by means of a second set of lock pins 5. After the supporting frame assembly 4 is secured to the control rod assembly 24, the mattress 6 is mounted on the supporting frame assembly 4 permitting the two side rods 41 to be received in the channels 611 of the two bottom rail portions 61. After assembly, a baby bathtub is formed as illustrated in FIG. 2.

Figure 3:
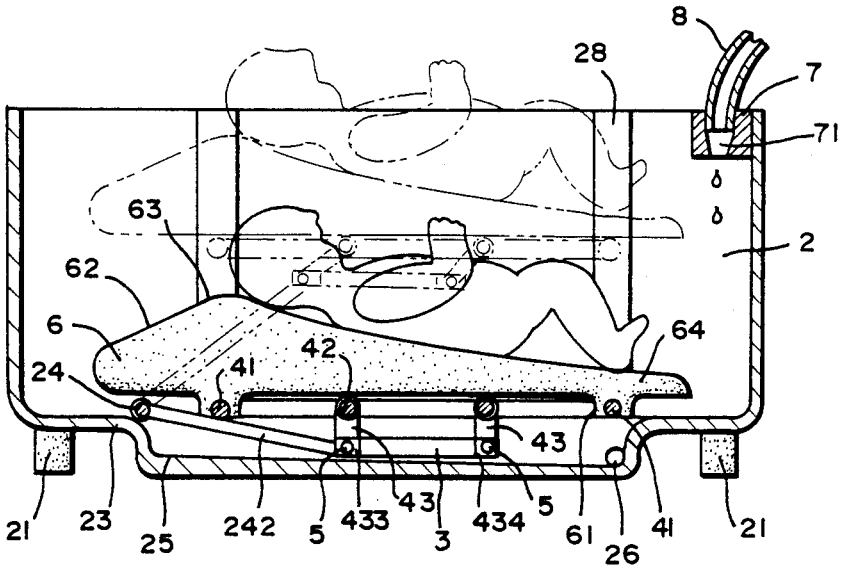
FIG. 3 is a sectional elevation of the baby bathtub of FIG. 1, illustrating a lifting operation.
Figure 4:
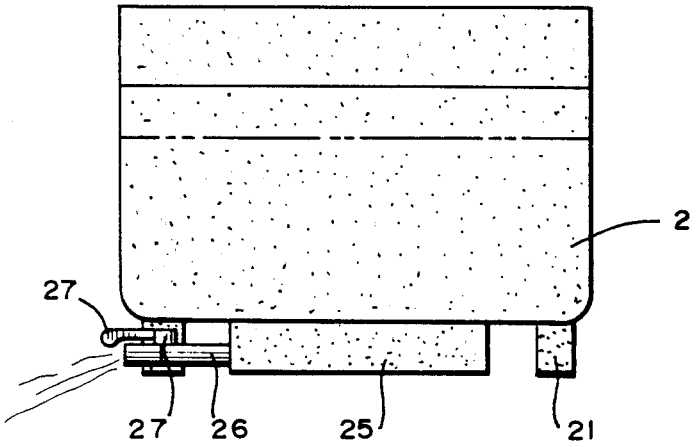
FIG. 4 is a schematic drawing illustrating the location of the drain pipe and the drain control device in a baby bathtub according to the present invention.

The operation of the present invention is outlined hereinafter. Referring to FIGS. 3 and 4, the extension handle 241 is pulled out of the retainer member 22 and turned downward so that the link rods 242 can be carried by the control rod assembly 24 to elevate the mattress 6. During lifting of the link rods 242, the toggles 3 is driven to force the supporting frame assembly 4 to move upward along the dovetail-like projections 28. As a consequence, the mattress 6 is simultaneously elevated by the supporting frame assembly 4. As soon as the mattress 6 reaches a desired level, the extension handle 241 is pushed back and set in the hook portions 221 of the retainer member 22 to fix the position of the mattress 6 at such a desired level. When in use, a baby is put on the scoop-like surface portion 64 of the mattress 6 with baby's head lying on the ridge portion 63 so as to prevent entering of water in baby's ears. Because the retainer member 22 comprises several hook portions 221, the extension handle 241 of the control rod assembly 24 can be alternatively retained therein according to level position required, i.e., the level position of the mattress 6 can be adjusted by means of the position change of the extension handle 241 in the hook portions 221 of the retainer member 22 (see FIG. 3). Further, through the operation of the drain control device 27 the drain pipe 26 can be turned on for draining of water from the housing 2, or plugged for filling of water in the housing 2 (see FIG. 4).

There is a pipe holder 7 internally mounted on the housing 2 at one corner at a higher position defining therein two tapered holes 71 and 72 respectively for the connection thereto of two water pipes 8 and 9 respectively for filling hot water and cold water in the housing 2.

I claim:

1. A baby bathtub, including:

a rectangular housing comprising a top, a closed bottom and a support leg at each bottom corner, a retainer member which comprises a plurality of hook portions vertically attached to and composite with the outer wall thereof at one corner, a unitary sleeve projecting from the inner wall thereof opposite to said retainer member for connection thereto of a control rod assembly, said control rod assembly comprising an extension handle retained by a desired one of said plurality of the hook portions of said retainer member, and two link rods extending from said control rod assembly and disposed in parallel relationship with each other, each of said link rods comprising a connecting end having a round hole therethrough a sloping recess made on the inner bottom of said rectangular housing, a drain pipe extending from said sloping recess for draining of water, said drain pipe controlled by a drain control device, two spaced unitary dovetail-like vertical projections respectively attached so as to be composite with each inner longitudinal wall surface thereof in parallel facing relationship with each other, two toggle members, each toggle member having a notch portion at each end, each notch portion having a hole therethrough;

a supporting frame assembly comprising a ladder-like frame having two side rods secured thereto relationship with each other at both ends of said supporting frame said ladder-like rod frame having two front and two rear fastening members movably mounted thereon each of, said two rear fastening members comprising a male fastening end having a hole therethrough each of, said two front fastening members comprising a female fastening end having a round hole therethrough, each of, said two side rods comprising a dovetail-like retaining plates at each end;

a mattress having an upper surface, a lower end and a pair of rail portions defining therein two channels, the upper surface of bottom said mattress is comprised of a raised sloping surface portion at its upper end, a ridge portion in the middle, and a scoop-like surface portion at its lower end;

wherein said supporting frame assembly is positioned in said housing with its retaining plates engaged with said four dovetail-like projections, said connecting ends of said link rods being set in the front notch portions of said two toggle members and concomitantly set in the female fastening ends of said two front fastening members and pivotably secured thereto by means of two lock pins, said male fastening ends of said two rear fastening members are set in the two rear notch portions of said two toggle members and pivotably secured thereto by means of a second set of lock pins, said mattress being mounted on said supporting frame assembly with said two side rods received in the channels of said two bottom rail portions and whereas the vertical position of said mattress can be adjusted via said supporting frame assembly via said control rod assembly.

2. A baby bathtub as claimed in claim 1, wherein said housing comprises a pipe holder at one corner at a top most position having therein tapered holes for the connection thereto of water pipes respectively for filling said housing with hot water and/or cold water.

* * * * *